United States Patent [19]

Doser

[11] 3,970,485

[45] July 20, 1976

[54] BINDER AND LUBRICANT REMOVAL FROM COBALT-RARE EARTH ALLOYS

[75] Inventor: Manfred Doser, Edmore, Mich.

[73] Assignee: Hitachi Magnetics Corporation, Edmore, Mich.

[22] Filed: Jan. 20, 1975

[21] Appl. No.: 542,189

[52] U.S. Cl. ..... 148/103; 148/31.57; 148/105

[51] Int. Cl.[2] ..... H01F 1/02

[58] Field of Search ..... 148/101, 103, 104, 105, 148/31.55, 31.57; 75/200, 211

[56] References Cited

UNITED STATES PATENTS

| | | | |
|---|---|---|---|
| 3,607,462 | 9/1971 | Laing | 148/104 |
| 3,681,151 | 8/1972 | Donkersloot et al. | 148/105 |
| 3,684,593 | 8/1972 | Benz et al. | 148/103 |
| 3,728,110 | 4/1973 | Klar et al. | 75/211 |
| 3,755,007 | 8/1973 | Benz et al. | 148/101 |
| 3,785,881 | 1/1974 | Naastepad | 148/103 |

OTHER PUBLICATIONS

Cech, R; *Sintering . . . $Co_5Sm$ Magnets*, in *Jour. Appl. Phys.*, 41, Dec. 1970, pp. 5247–5249.

*Primary Examiner*—Walter R. Satterfield
*Attorney, Agent, or Firm*—Allard A. Braddock

[57] ABSTRACT

An organic binder or lubricant in a pressed or compacted green body formed of cobalt-rare earth intermetallic particles is substantially removed from the green body before the carbon can react with the rare earth during sintering. This is accomplished by exposing the green body to a temperature of about 100° to 300°C in a hydrogen-containing atmosphere. The hydrogen reacts with the organic binder or lubricant which allows the resulting organic molecules to volatilize from the green body. The green body is then sintered after which it is cooled to room temperature.

8 Claims, No Drawings

BINDER AND LUBRICANT REMOVAL FROM COBALT-RARE EARTH ALLOYS

BACKGROUND OF THE INVENTION

Permanent magnets composed of cobalt and rare earth alloys have come into prominence in recent years because of the very high energy product of such magnets and because they can maintain a high and constant magnetic flux in the absence of an exciting magnetic field.

In order to prepare cobalt-rare earth magnets having the most desirable properties, it is necessary to exercise great care in the production of such magnets. Cech U.S. Pat. No. 3,748,193 discloses and claims the production of cobalt-rare earth intermetallic alloys by reacting cobalt, samarium oxide and calcium hydride to reduce the samarium oxide and diffuse the cobalt and samarium together to form the alloy. Benz U.S. Pat. Nos. 3,655,463, 3,655,464, 3,695,945 and Benz and Martin U.S. Pat. No. 3,684,593 disclose and claim processes for making sintered cobalt-rare earth magnets.

During the course of producing magnets by the various Benz processes, fine particles of cobalt-rare earth materials are pressed or compacted into a green body. The incorporation into the particles of an internal lubricant or binder will achieve denser green bodies, prolong tool life, and produce better powder flowability during the cavity filling. For this reason it is very desirable that lubricants or binders be present at the time of the pressing or compacting. However, rare earths will readily react chemically with the carbon of the binder material during the subsequent sintering of the green bodies. This reaction detracts considerably from the properties of the final magnetic product. Since sintering is a necessry part of the process for producing satisfactory magnets, it has been customary to omit internal binders or lubricants from the particles themselves and instead rely upon external lubricants or binders to the extent that they can provide improved pressing or compacting. At best, however, external binders or lubricants are inferior to internal binders or lubricants.

Not only does carbon react readily at elevated temperatures with rare earths but also other elements such as hydrogen or nitrogen. The patents cited above all emphasize the importance of using inert atmospheres such as would be provided by argon or helium in the course of sintering or heat treating cobalt-rare earth materials.

SUMMARY OF THE INVENTION

In accordance with this invention a green body composed of pressed or compacted cobalt-rare earth material in which an organic binder or lubricant has been incorporated is heated to an intermediate temperature of about 100° to 500°C in the presence of a hydrogen-containing atmosphere and held at this intermediate temperature for a period of the order of a half-hour. At this intermediate temperature the hydrogen reacts with the organic lubricant or binder which allows the resulting molecules to be baked or volatilized off the green body. The green body is then subjected to further treatment such as sintering, cooling, heat treatment, etc.

DESCRIPTION OF PREFERRED EMBODIMENTS

The term "cobalt-rare earth" has come to mean a large class of materials. For example, magnets of highly desirable magnetic properties are produced if iron, manganese, aluminum, nickel, or copper, or mixtures thereof, are present as alloy materials with cobalt. In addition the proportions of the cobalt and rare earth material may vary. For instance, good results have been achieved with such compounds as $Co_5R$ and $Co_{17}R_2$, and mixtures of these with $Co_7R_2$, $Co_3R$ and $Co_2R$ (R represents a rare earth atom). The rare earth metals useful in the present invention are the fifteen elements of the lanthanide series having atomic numbers 57 to 71, inclusive. The element yttrium (atomic number 39) is commonly found with and included in this group of metals and is therefore considered a rare earth metal. Accordingly, as used herein, the term "cobalt-rare earth" may be considered as encompassing the variations described above.

In a typical procedure in accordance with this invention a cobalt-rare earth alloy is formed containing a major amount of $Co_5R$ intermetallic phase and a second CoR phase which is richer in rare earth metal content than the $Co_5R$ phase. This alloy, in particulate form, is mixed with about ½–2% of an organic binder or lubricant and pressed into a shape known as a "green body". The green body is then heated in a hydrogen-containing atmosphere to a temperature of 100° to 500°C and preferably to about 100° to 300°C. It is held at this temperature and in this atmosphere for a period of about one-half hour for small parts and longer for large parts before being subjected to a sintering temperature of about 1100°C or more. It is the intermediate temperature of 100° to 500°C which is the subject of the present invention. Conditions for sintering and additional treatments are disclosed and claimed in Doser and Jones application, Ser. No. 542,190, filed of even date herewith.

Most lubricants-binders consist of long hydrocarbon chains, cyclic chains, etc., which generally have low vapor pressures until temperatures of 300°C or higher are reached. Typical lubricants-binders are stearic acid, water-soluble waxes, aliphatic alcohols of from $C_{16}$ to $C_{36}$ chain length, microcrystalline waxes, acrylic resins, alkyd resins, vinyl polymers, polytetrafluoroethylene, nylon, naphthalene, and petroleum greases. Many of these are sold under trade designations such as Elvacite, Microwax, Teflon, Acrawax, Carbowax, etc.

The practice of this invention does not require that the atmosphere be composed entirely of hydrogen. An atmosphere containing as little as one percent hydrogen by volume (the rest being an inert atmosphere) will slowly react with the lubricant-binder during a bake cycle. However, since it is hydrogen which is the active component, it is preferable that hydrogen be present in major quantity. An atmosphere composed entirely of hydrogen is satisfactory in carrying out the invention. It is probable that there is some reaction between the hydrogen and the rare earth components of the green body. It was previously thought that any such reaction would be ditrimental to the final magnetic product. A surprising aspect of the invention is the discovery that the use of hydrogen to remove binders and lubricants from a green body does not result in detriment to the high-performance properties of the final product. The aforementioned Doser and Jones application shows that hydrogen confers definite benefits on the final product under sintering conditions and other treatments.

The action of hydrogen in removing the organic binder materials from green bodies is not completely understood. However, it is believed that the hydrogen cleaves the long chain molecules thereby increasing their volatility. In the petroleum trade this action is known as "cracking". The remaining volatile molecules can be baked off of the green bodies at lower temperatures at which the rare earth materials are less chemically active and thus less prone to form carbides with the carbon of the binders and lubricants.

The invention is illustrated using CoSm powders made in accordance with the Cech and Benz patents described above. The binder was N,N'-ethylenediisostearamide.

TABLE I

| Example | Baking Atmosphere | Treatment Temperature | Sintering Atmosphere | Wt. Percent Carbon After Sintering |
|---|---|---|---|---|
| 1 | Argon | 400°C | Argon | 0.36 |
| 2 | Vacuum | 400°C | Argon | 0.25 |
| 3 | Vacuum | 250°C | Argon | 0.23 |
| 4 | Hydrogen | 250°C | Argon | 0.04 |
| 5 | Hydrogen | 400°C | Hydrogen | 0.08 |
| 6 | Hydrogen | 250°C | Hydrogen | 0.05 |
| 7 | Hydrogen | 800°C | Hydrogen | 0.07 |
| 8 | Vacuum | 250°C | Hydrogen | 0.15 |
| 9 | Hydrogen | 250°C | Hydrogen | 0.07 |
| 10 | Hydrogen | 250°C | Hydrogen | 0.06 |

The powder of examples 1–10 as ground with no binder or lubricant added contained from 0.05 to 0.08 weight percent carbon. Examples 1–8 contained 0.5 weight percent binder before baking. Examples 9 and 10 contained 1 and 1.5 weight percent binder, respectively. In all cases the baking was continued for a period of 30 minutes.

Example 1 illustrates that baking in argon results in the removal of only a small portion of the carbon of the binder-lubricant. Example 2, 3 and 8 show that baking in a vacuum removes somewhat more of the carbon but still leaves a fair amount to form a carbide with the rare earth during a subsequent sintering operation. Examples 4, 5, 6, 9 and 10 show that baking in hydrogen brings the carbon level down to where it was prior to adding a binder or lubricant. Example 7 is interesting as it shows that a bake at 800°C does not remove any more of the carbon than a bake at 250°C. A temperature of the order of 250°C is preferred as it results in the reaction of hydrogen with the binder or lubricant without subjecting the green body to treatment for an unduly long time. Higher temperatures increase the reactivity of the rare earth alloy.

Samarium was the rare earth used in all of the examples of Table I. However, this was largely because samarium is readily available in pure form and is representative of rare earths as a class. Other rare earths give comparable results and mixtures of rare earths known as mischmetal (MM) may be used. Particularly useful mixtures are samarium with cerium-mischmetal, samarium-praseodymium, samarium-gadolinium and samarium-neodymium.

The invention has been described with reference to certain specific embodiments but it is obvious that there may be variations which properly fall within the scope of the invention. Therefore, the invention should be limited only as may be necessitated by the scope of the appended claims.

What I claim as new and desire to secure by Letters Patent of the United States is:

1. A process for producing a cobalt-rare earth intermetallic product having substantially stable permanent magnet properties which comprises providing an alloy of cobalt and rare earth metal in particulate form, said cobalt and rare earth metal being used in proportions substantially corresponding to those desired in a final sintered product, mixing an organic binder material with said particulate alloy, pressing said particulate alloy into a green body, subjecting said green body to a bake cycle in an atmosphere containing 1 to 100% by volume hydrogen at an intermediate temperature of between 100° and 500°C for about a half-hour whereby the hydrogen reacts with the molecules forming the organic binder and the resulting molecules volatilize from the green body, and thereafter sintering said body.

2. The process of claim 1 wherein the intermediate temperature is within a range of 100° to 300°C.

3. The process of claim 2 in which the temperature is about 250°C.

4. The process of claim 1 in which the rare earth is samarium.

5. The process of claim 1 in which the rare earth is a mixture of samarium and cerium-mischmetal.

6. The process of claim 1 in which the rare earth is a mixture of samarium and praseodymium.

7. The process of claim 1 in which the rare earth is a mixture of samarium and gadolinium.

8. The process of claim 1 in which the rare earth is a mixture of samarium and neodymium.

* * * * *